US006799357B2

(12) United States Patent
Webb et al.

(10) Patent No.: US 6,799,357 B2
(45) Date of Patent: Oct. 5, 2004

(54) MANUFACTURE OF METAL TUBES

(75) Inventors: Neal Webb, San Jose, CA (US); Philippe Poncet, Sandy Hook, CT (US); Ming H. Wu, Bethel, CT (US); Scott Carpenter, Fremont, CA (US); Jesse Perez, Newark, CA (US); Paul Adler, Livermore, CA (US)

(73) Assignee: Memry Corporation, Bethel, CT (US)

( * ) Notice: Subject to any disclaimer, the term of this patent is extended or adjusted under 35 U.S.C. 154(b) by 0 days.

(21) Appl. No.: 10/235,080

(22) Filed: Sep. 5, 2002

(65) Prior Publication Data

US 2003/0110825 A1 Jun. 19, 2003

Related U.S. Application Data

(60) Provisional application No. 60/323,565, filed on Sep. 20, 2001.

(51) Int. Cl.[7] ..... B23P 17/00
(52) U.S. Cl. ..... 29/423; 72/370.01
(58) Field of Search ..... 72/283, 370.01, 72/370.24, 7; 29/423

(56) References Cited

U.S. PATENT DOCUMENTS

| | | | |
|---|---|---|---|
| 2,196,646 A | 4/1940 | Smith | |
| 2,809,750 A | 10/1957 | Arenz | |
| 4,186,586 A | 2/1980 | Takamura et al. | |
| 4,300,378 A | 11/1981 | Thiruvarudchelvan | |
| 4,631,094 A | 12/1986 | Simpson et al. | |
| 4,653,305 A | 3/1987 | Kanamaru et al. | |
| 5,056,209 A | 10/1991 | Ohashi et al. | |
| 5,709,021 A | 1/1998 | DiCello et al. | |
| 6,453,536 B1 | 9/2002 | Muller et al. | 29/423 |

FOREIGN PATENT DOCUMENTS

| | | |
|---|---|---|
| FR | 980.957 | 1/1951 |
| GB | 362539 | 12/1931 |
| WO | WO 99/22886 | 5/1999 |

OTHER PUBLICATIONS

Japanese Abstract for JP 62199218 A Feb. 27, 1986.
International Search Report, mailed Dec. 23, 2002.

*Primary Examiner*—Lowell A. Larson
(74) *Attorney, Agent, or Firm*—Cantor Colburn LLP

(57) ABSTRACT

The manufacture of seamless tubes in which the process includes providing an assembly having a metal tube blank, and an elongate metal core of shape memory effect material which is surrounded and contacted by the tube blank with a minimal gap. The assembly is elongated by mechanical working thereof at an elevated temperature until the tube blank has been converted into a tube of desired dimensions. After the elongation step, the core is subjected to a treatment which results in the core being in a stretched condition throughout its length, and does not substantially stretch the tube. The core is removed from the tube, and subsequently subjected to drawing passes over a nondeformable mandrel thereby refining the precision of diametric and wall dimensions with improved ID and OD surface quality. There is also decoring and reinserting to improve final dimensions which results in the ability to fabricate smaller, longer tubes.

30 Claims, 1 Drawing Sheet

MANUFACTURE OF METAL TUBES

CROSS REFERENCE TO RELATED APPLICATIONS AND PATENTS

The present invention is an improvement over the invention described in U.S. Pat. No. 5,709,021 which issued on Jan. 20, 1998, and the text of which is hereby incorporated herein by reference.

The present application has the benefit of the filing date of U.S. Provisional Application No. 60/323,565 filed Sep. 20, 2001.

FIELD OF THE INVENTION

The present invention relates generally to the metal tube art, and, more particularly, to the manufacture of seamless, shape memory, metal tubes, especially those using nickel-titanium or titanium alloys.

BACKGROUND OF THE INVENTION

Most seamless metal tubes are made by working a tube blank over a nondeformable mandrel and/or in combination with a sinking process where the tube is drawn through a die without internal support. Such discontinuous processes are slow and expensive, and can only produce tubes of limited length. It is also known to make seamless tubes of uniform cross section by mechanical working of an assembly of a core and a tube blank, thus elongating both the core and the tube blank, and then removing the core. Core removal has been achieved, depending on the core material, by melting a core which melts at a temperature below the melting point of the tube, by selectively dissolving the core, or according to a previous invention by mechanically stretching the core to a reduced diameter to facilitate core removal. Dimensional precision and internal surface quality for the deformable mandrel process are also more difficult to control as the plastic flows for the blank and the core can be different when the core is made of a different material from the tube blank. Assembly gap or clearance between the core and the tube blank can also contribute to the degradation of internal surface quality. Even when the core and the tube blank are made of the same material, it is believed that drawing friction may lead to different elongation between the tube blank and the core.

United Kingdom Patent No 362539 discloses production of hollow metal bodies.

French Patent No. 980957 discloses assembling a tube blank with a core, mechanical working reduction without bonding, further core elongation to enable longitudinal removal and then removal of the core.

U.S. Pat. No. 2,809,750 discloses a mandrel for extrusion press.

U.S. Pat. No. 4,186,586 discloses a billet and process for producing a tubular body by forced plastic deformation. In this patent the entire billet 10 is subjected to plastic deformation which includes both the center core 13 and the sheath pipe 12. There is hydrostatic co-extrusion of a metallic tube blank and metallic core separated by a solution removable salt layer. After reduction, the salt layer defines an annular gap so that after dissolving the salt, the metallic core can be longitudinally withdrawn.

U.S. Pat. No. 4,300,378 discloses a method and apparatus for forming elongated articles having reduced diameter cross-section. The billet is a solid sample and does not have a tube in connection with a mandrel. This patent shows a standard process of tube extrusion about a conical mandrel 106.

U.S. Pat. No. 4,653,305 discloses a method and an apparatus for forming metallic article by cold extrusion from a metallic blank.

JP 62199218 A (Furukawa Electric Co LTD) 2 Sep. 1987, discloses the making of shape memory alloy pipe in which a mandrel is inserted into a cylinder made of shape memory alloy, the cylinder and mandrel are reduced integrally and the mandrel is pulled out after a heat treatment. It shows co-reduction of a tubular nickel-titanium shape memory alloy blank and stainless steel core using shape memory effect of the tube material (a rolled up, welded and thickness reduced sheet) to expand the tube to enable core removal.

U.S. Pat. No. 5,056,209 discloses a process for manufacturing clad metal tubing. It shows a method of co-extruding concentric metal tubes to form a clad bimetallic tubular end product. The materials are carbon steel tubing as an outer tube and harder to work materials having higher deformation resistance.

U.S. Pat. No. 5,709,021 discloses a process for the making of metal tubes in which a seamless metal tube is made by elongating an assembly of a tube blank and a metal core by mechanical working, and then stretching the core.

BRIEF SUMMARY OF THE INVENTION

Objects of the present invention are to overcome the difficulties of the prior art and to produce a better product than the prior art. These objects and others, are accomplished in accordance with the present invention which provides that these problems can be overcome by employing: (1) shape memory effect to reduce the assembly gap or clearance between the core and the blank (in the smaller formats); and (2) a drawing process which reduces or eliminates relative elongation between the core and the tube during drawing; or (3) a hybrid process comprising a deformable mandrel process for the up-stream reductions and a nondeformable mandrel process for the final finishing passes. Lubricants between the core and the tube may be beneficially used during the process. Also, there is a benefit in using decoring and reinserting, which provides the ability to fine tune the ratio at closer to the final size in order to better control final dimensions, and allows for a new lube layer to be added between the tube and core thus easing decorability for small, long tubes.

The invention can be used to make shape memory alloy such as NiTi family alloy tubes having a wide range of sizes, but is particularly useful for making thin wall tubes of small diameter, for example of inner diameter from 0.005 to 1.0 inch (0.13 to 25.4 mm), e.g., 0.005 to 0.125 inch (0.13 to 3.2 mm) and wall thickness 0.001 to 0.2 inch (0.025 to 5 mm), e.g., 0.002 to 0.1 inch (0.05 to 2.5 mm). The length of the tube can vary widely. Thus the invention can be used to make tubes of considerable length, e.g., more than 20 feet, or even more than 100 feet, with the upper limit being set by the equipment available to stretch the core.

In the smaller formats there can be improvements if a decoring and reinserting step is used.

Other objects, features and advantages will be apparent from the following detailed description of preferred embodiments taken in conjunction with the accompanying drawings in which:

DETAILED DESCRIPTION OF THE DRAWINGS

Figure 1:
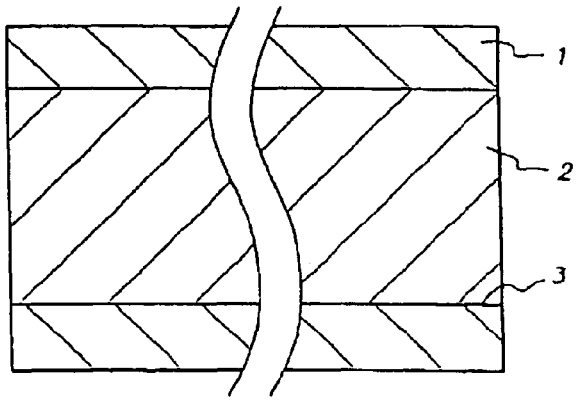
FIGS. 1 and 2 are diagrammatic longitudinal and transverse cross sections of an assembly of a core and a tube blank at the beginning of the method of the invention.

In a preferred aspect, this invention provides a method of making shape memory alloy tubes such as binary NiTi alloy and its modified ternary and quarternary compositions with precisely controlled outside (OD) and inside (ID) diameters, wall thicknesses and improved OD and ID finishes. The method comprises:

1. providing an assembly which comprises (a) a metal tube blank, and (b) an elongate metal core which is surrounded and has line contact with the tube blank with minimal gap, and a lubricant between the core and the tube may be beneficially used;
2. elongating the assembly by mechanical working, which may be at an elevated temperature (hot working) where the core and the blank are having similar rate of plastic flow thereof until the tube blank has been converted into a tube of desired dimensions, or is cold drawn from an annealed state;
3. heat treating the elongated assembly while straightening the assembly under longitudinal stresses at a temperature above the recrystalization temperature of the tube blank;
4. after step (3), subjecting the core to a treatment which results in the core being in a stretched condition throughout its length, and which does not substantially stretch the tube;
5. removing the stretched core from the tube;
6. after step (5), the process steps (1) through (5) may be repeated to achieve smaller tubing sizes;
7. after the final decore process of step (5) and before the finished size, the tube is preferably subjected to subsequent drawing passes over a nondeformable mandrel or a floating plug, and/or in combination with a sinking process, thereby refining the precision of diametric and wall dimensions with improved surface quality; and
8. after the final drawing pass of step (7), heat treating the tube while being straightened under longitudinal stresses at a temperature above the recrystalization temperature.

Step 1—Assembly with Tube Blanks

The cores used in this invention must provide satisfactory results while the assembly of the tube blank and the core is being assembled, while the assembly is being mechanically worked, and while the core is being converted into a stretched condition after the mechanical working is complete. The criteria for selecting a core metal which will enable the core to meet the mechanical working and the ease of decoring requirements have been described in a prior patent (U.S. Pat. No. 5,709,021). To meet the criteria for the improvements disclosed in the present invention for the manufacture of a shape memory alloy, such as NiTi, tubing, the core metal preferably is also a NiTi alloy having substantially the same working characteristics under the chosen working conditions, so that the extent to which the core is extruded out of, or sucked into, the tube, is limited. It is also preferred that the NiTi core metal in the deformed condition has a reverse martensitic transformation start (As) temperature above 20° C. A superelastic core would also perform properly by stretching and making the assembly at a sub-ambient or cryogenic temperature. Such a NiTi core when deformed to a reduced diameter, assembled with the tube blank and subsequently heated above the Af temperature during the annealing process will recover the original diameter. An originally superelastic core can also be over-deformed, such as by stretching over the recoverable strain limit, thereby temporarily raising the austenite transformation temperature above the ambient as described in U.S. Pat. No. 4,631,094. The originally superelastic core after such an over-deformation has a stable geometry in the deformed condition until being heated above the austenite transformation temperature. Employing such a process, an originally superelastic core can be inserted and removed without cooling to a cryogenic temperature. By proper selections of starting and finished dimensions, the shape memory recovery of the core diameter will minimize the assembly gap between the core and the tube blank. For example, to assemble a core of 1.00 inch diameter into a blank ID of 1.02 inch will result in an assembly gap of 0.02 inch. According to the present invention, a NiTi core can be cold worked, by swaging, by drawing or by stretching, to a reduced diameter for ease of assembly, to be capable of recovering 2% of its diameter when heated, and centerless ground to a finished diameter of 1.00 inch. The centerless ground NiTi core is then assembled with the tube blank into an assembly and subsequently heated to induce shape recovery of the core. A 2% diametric recovery of the core thus eliminates the 0.02 inch assembly gap allowing a smooth reduction of tube blank ID against the core diameter during subsequent reductions. Reduction of ID tightly against the core diameter ensures that a smooth ID finish is maintained during subsequent reduction. The process can be used also in step (5) for reinsertion of core material after an intermediate step of core removal.

Preferred core metals in this invention include shape memory metals having similar plastic flow characteristics to those of the tube blank. Shape memory metals exist in an austenitic state and in a martensitic state, and undergo a transition from the austenitic state to the martensitic state when cooled, the transition beginning at a higher temperature Ms, and finishing at a lower temperature Mf. Preferred core metals for the manufacture of nickel-titanium alloy tubes and their ternary or quarternary modified compositions include both binary alloys and alloys containing one or more other metals in addition to nickel and titanium, for example, one or more of iron, cobalt, manganese, chromium, vanadium, molybdenum, zirconium, niobium, hafnium, tantalum, tungsten, copper, silver, platinum, palladium, gold and aluminum.

A preferred binary alloy core comprises 54.5 to 56.0%, preferably less than 55.5% nickel and the balance of titanium, since alloys in this composition range have the reverse martensitic transformation (from martensite to austenite) temperatures above the ambient. Throughout this specification the percentages given for ingredients of alloys are by weight, based on the weight of the alloy. Binary alloys containing more than about 55.5% nickel, the balance titanium, can also be used, but when using such alloys, it may be necessary to deform the core more severely to elevate the As and Af temperatures above the ambient, as described in U.S. Pat. No. 4,631,094.

There are elements which can be added to nickel titanium alloys and which increase the As and Af temperatures. Such elements include copper, hafnium, platinum, paladium, silver and gold, and they can usefully be present in the alloy in order to elevate the reverse transformation temperatures. Typically such elements are present in an amount of about 0.1 to 20% in an alloy containing 55.5 to 56.0% nickel, with the balance titanium.

Another useful class of nickel titanium alloys includes 41 to 47% titanium, 0.1 to 5% aluminum, and the balance nickel. The presence of the aluminum produces an alloy which can be subjected to precipitation hardening.

The invention can be used to make a tube of any metal whose working characteristics enable the tube blank and the core to be elongated at similar rates of plastic flow by mechanical working. Nickel titanium alloys which can be used as tube metals include those disclosed herein as being suitable for use as core metals. Examples of other tube metals include alloys containing titanium, and one or more other metals, e.g. nickel, aluminum, vanadium, niobium, copper, and iron. In one class of such alloys, the titanium is present in an amount of at least 80%, preferably 85 to 97%, and the alloy also contains one or both of aluminum and vanadium, for example, the alloy containing about 90% Ti, about 6% Al and about 4% V, and the alloy containing about 94.5% Ti, about 3% Al and about 2.5% V. In another class of such alloys, the titanium is present in an amount of 76% to 92.5% and the alloy also contains about 7.5% to 12% Mo, 0 to about 6% Al, 0 to about 4% Nb and 0 to about 2% V. In yet another class of such alloys, the titanium is present in an amount of 35 to 47% and the alloy also contains about 42 to about 58% nickel, 0 to about 4% iron, 0 to about 13% copper and 0 to about 17% niobium. Other tube metals include reactive metals and alloys (i.e. metals and alloys which will react with oxygen and/or nitrogen if subjected to mechanical working in air and which must, therefore be processed in an inert medium or within a non-reactive shell, e.g. of stainless steel, which is removed at any convenient stage after the mechanical working is complete), including in particular, titanium, zirconium and hafnium. Other tube metals include intermetallic compounds, e.g., nickel aluminides and titanium aluminides, many of which are difficult to work at room temperature and must be worked at the elevated temperatures at which they are ductile.

The dimensions of the tube blank and the core in the assembly are determined by the dimensions which are required in the finished tube and the equipment available for the mechanical working of the assembly. These are matters well known to those skilled in the art, and do not require detailed description here. For example, the core and tube blank can have a length of 3 to 100 inch (76 to 2500 mm), e.g. 12 to 48 inch (300 to 1220 mm); the outer diameter of the tube blank can be 0.1 to 2 inch (2.5 to 51 mm), preferably 1 to 1.5 inch (25 to 40 mm); the diameter of the core and the inner diameter of the core blank can be 0.3 to 1 inch (7.6 to 25.5 mm), preferably 0.5 to 0.9 inch (12.5 to 23 mm); and the ratio of the outer diameter of the tube to the inner diameter of the tube can be from 1.01 to 2.5, preferably 1.15 to 2.0. These dimensions are examples, which should not be interpreted as limiting the scope of the invention. The ratio of the inside diameter of the tube product to the outside diameter of the tube product is substantially the same as in the tube blank.

We have found that improved results are obtained in the stretching of the core and removal of the stretched core if a lubricant is placed between the tube blank and the core in the initial assembly. For example, we have used graphite, which is preferred, and molybdenum disulfide as lubricants.

Step 2—Mechanical Working of the Assembly of the Tube Blank and the Core

Proceeding from the first step of the process, an assembly of the tube blank and the core is subjected to mechanical working so as to elongate the assembly until the tube has the desired final dimensions. Such procedures involve multiple drawing through dies of ever-decreasing diameter, at high temperatures and/or at lower temperatures with annealing after low temperature drawing steps. It was found in the present invention that even for an assembly having similar plastic flow characteristics for the tube blank and for the core, due to the presence of significant friction between the tube and the drawing die typical drawing processes often induce different elongation between the tube and the core. It was also found that by varying the drawing temperature, one can manipulate the relative elongation between the core and the tube, therefore, by selecting a properly optimized drawing temperature, the relative differential elongation between the tube and the core can be minimized resulting in much better preservation of ID-to-OD ratio and the ID smoothness. As an example, drawing an assembly with a Ti-55.8 wt. % Ni tube and a Ti-54.5 wt. % Ni core at temperatures below 400° C. always results in more elongation of the tube than of the core while increasing the drawing temperature to 600° C. results in similar elongation of the tube as well as of the core. It was observed that the tube drawn at 600° C. preserves the ID and OD ratio better and has a much more smooth ID surface than the tube drawn at higher or lower temperatures.

Temperatures in the range of 200° C. to 700° C. may be used. Also, the ratio can be changed, modified or affected by changing the reduction per pass, die design and/or to some extent drawing speed. The temperatures listed are furnace temperatures, not the actual drawing temperatures at the die.

After the core and the tube blank have been elongated by thermo-mechanical working, the elongated assembly is cut into lengths which can be conveniently handled in available equipment such as a draw bench. Unless the final mechanical working step is carried out at an elevated temperature such that the core is sufficiently free of stress to be stretched, the assembly must be stress relieved or annealed. The stress relieving or annealing can be carried out either before or after the assembly is cut up into sections. Other reduction methods could be used, such as, extrusion, swaging and rolling.

Step 3—Heat Treating and Straightening as Indicated Earlier.

Steps 4 and 5—Stretching and Removal of the Core

The decoring process has been described in U.S. Pat. No. 5,709,021.

Step 6—Sizing and Finishing Using a Non-deformable Mandrel or Floating Plug Process Even using the improvements discussed herein, it was observed that the dimensional tolerance, in particular, the precision of wall thickness, appears to have inherent limitation in the deformable mandrel process. For example, a Ti-55.8 wt % Ni tube after drawing using a deformable mandrel process from 1.25 inch OD to 0.05 inch OD has a typical concentricity (minimum thickness/maximum thickness) in a range between 0.88 and 0.92. However, we found that concentricity and dimensional control are improved by taking tubes manufactured by a deformable mandrel drawing process at either elevated (hot or warm drawing) or ambient (cold drawing) temperatures and drawing the tube through a number of passes of non-deformable mandrel significantly improves the concentricity. For example, taking a tube of 0.235 inch OD and 0.196 inch ID manufactured using a deformable mandrel process and having a concentricity of 0.92 and subsequently drawing the tube using a fixed mandrel of hardened steel to 0.192 inch OD, we found that the concentricity was gradually improved to 0.95. In another example, tubes of 0.062 inch OD and 0.0508 inch ID produced by a deformable mandrel process have a typical concentricity in a range of 0.902–0.926. Tubes of this size can also be produced by the same deformable mandrel process first to 0.083 inch OD and 0.0626 inch ID and, after decoring and annealing, subsequently drawn to the finished 0.062 inch OD and 0.0508 inch ID using a nondeformable hardened steel mandrel. The nondeformable mandrel drawing is accomplished in five drawing passes with an interpass annealing. Tubes produced by such a hybrid drawing process consistently show better controlled dimensions with improved concentricity typically in a range of 0.946–0.978. Using a floating plug drawing process should achieve similar improvement on concentricity. Either a non-deformable mandrel process or a floating plug process also renders better control on the OD and ID and therefore the OD/ID ratio as the OD is precisely controlled by the size of drawing die while the ID is sized with precision by the mandrel or plug diameter.

Steps 7 and 8—as Indicated Earlier.

Figure 2:
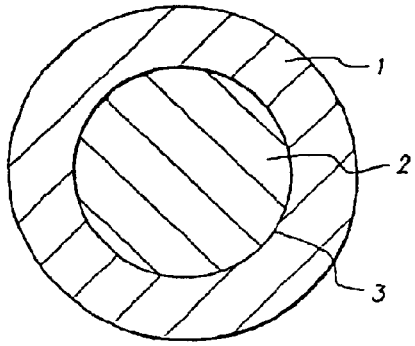
Figure 3:
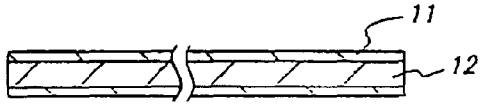
FIG. 3 is a diagrammatic longitudinal cross section through an assembly which has been elongated by mechanical working.

Referring now to the drawings. FIGS. 1 and 2 show an assembly which is suitable for use as a starting material in this invention and which comprises a tube blank 1 surrounding a core 2. Between the tube blank and the core is a very thin layer 3 of a lubricant. FIG. 3 shows an elongated assembly which has been prepared by mechanical working of the initial assembly shown in FIGS. 1 and 2, and which comprises a tube 11 and an elongated core 12.

Figure 4:
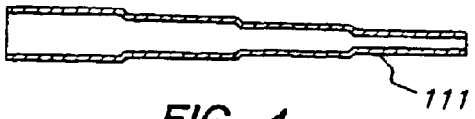
FIGS. 4 and 5 are diagrammatic longitudinal cross sections through tapered tubes of the invention.
Figure 5:
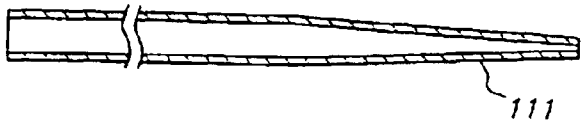

FIGS. 4 and 5 show tubes of the invention comprising a tapered portion 111.

It will now be apparent to those skilled in the art that other embodiments, improvements, details, and uses can be made consistent with the letter and spirit of the foregoing disclosure and within the scope of this invention.

What is claimed is:

1. A method for making seamless tubes, comprising:

providing an assembly which includes i. a metal tube blank, and ii. a cold worked elongated metal core of shape memory effect material which is surrounded and contacted by the tube blank with a minimal gap;

elongating the assembly by mechanical working thereof until the tube blank has been converted into a tube of desired dimensions;

subjecting the core to a treatment which (i) results in the core being in a stretched condition throughout its length, and (ii) does not substantially stretch the tube;

removing the stretched core from the tube; and subjecting the tube to drawing passes over a nondeformable mandrel thereby refining the precision of diametric and wall dimensions with improved inner diameter and outer diameter surface quality.

2. The method defined in claim 1 further comprising subjecting the tube to drawing passes over a floating plug.

3. The method defined in claim 1 further comprising the step of subsequently subjecting the tube to drawing passes over a floating plug.

4. The method defined in claim 1 wherein the core metal in the stretched condition has a reverse martensitic transformation start (As) temperature greater than 20° C.

5. The method as defined in claim 4 wherein the core is stretched and assembled with the tube blank below the As temperature.

6. The method defined in claim 1 wherein the core, when deformed to a reduced diameter, assembled with the tube blank, and subsequently heated above the Af temperature during the heating process recovers at least part of the original diameter.

7. The method as defined in claim 1, wherein the core metal exhibits at least partial superelasticity at ambient temperature and has reverse martensitic transformation start (As) temperature below 20° C.

8. The method as defined in claim 1, wherein the subjecting the core to a treatment comprises a hot draw for eliminating relative elongation between the core and the tube during drawing.

9. A method as defined in claim 8, wherein the temperature during the hot draw is chosen for minimizing the relative differential elongation between the tube and the core.

10. A seamless tube made by the method as defined in claim 9 wherein the drawing environment temperature is about 200° C. to 700° C.

11. The method as defined in claim 1 wherein the tubing is of NiTi and the core is of NiTi, and the core has similar flow characteristics to the tubing.

12. The method as defined in claim 11 wherein the NiTi core metal in stretched condition has a reverse martensitic transformation start (As) temperature greater than 20° C.

13. The method as defined in claim 12 wherein the core when deformed to a reduced diameter assembly with the tube blank and later heated above the Af temperature during heating recovers at least part of the original diameter.

14. The method as defined in claim 11, wherein the core metal exhibits at least partial superelasticity at ambient temperature and has reverse martensitic transformation start (As) temperature below 20° C.

15. The method as defined in claim 14 wherein the core is stretched and assembled with the core blank below the As temperature.

16. The method as defined in claim 13 or claim 15 wherein the starting and finished dimensions are selected so that the shape memory recovery of the core diameter minimizes the assembly gap between the core and the tube blank.

17. The method as defined in claim 1 wherein the core is used and assembled with the tube blank and heated to induce shape recovery of the core to minimize any gap and allow smooth reduction of the tube blank ID against the core diameter during subsequent reductions and to ensure that a smooth ID finish is maintained during subsequent reduction.

18. The method as defined in claim 17 wherein the centerless grinding is used for reinsertion of core material after an intermediate step of core removal.

19. A seamless tube made by the method defined in claim 1 in which the core metal in the deformed condition has a reverse martensitic transformation start (As) temperature greater than 20° C.

20. A seamless tube made by the method defined in claim 1 in which the core, when deformed to a reduced diameter, assembled with the tube blank, and subsequently heated above the Af temperature recovers at least part of the original diameter during the heating process.

21. A seamless tube made by the method defined in claim 1 in which the core metal exhibits at least partial superelasticity at ambient temperature and has reverse martensitic transformation start (As) temperature below 20° C.

22. A seamless tube made by the method defined in claim 1 in which the tubing is of NiTi and the core is of NiTi, and the core has similar flow characteristics as the tubing.

23. A seamless tube as defined in claim 22 wherein the NiTi core metal in deformed condition has a reverse martensitic transformation start (As) temperature greater than 20° C.

24. A seamless tube as defined in claim 23 wherein the core, when deformed to a reduced diameter assembly with the tube blank and later heated above the Af temperature recovers at least part of the original diameter during heating.

25. A seamless tube as defined in claim 22 wherein the core metal exhibits at least partial superelasticity at ambient temperature and has reverse martensitic transformation start (As) temperature below 20° C.

26. A seamless tube as defined in claim 25 wherein the core is stretched and assembled with the core blank below the As temperature.

27. A method as defined in claim 1 wherein a lubricant is used between the core and the tube blank.

28. A method as defined in claim 27 wherein the lubricant is graphite and/or molybdenum disulfide.

29. A method for making seamless tubes, comprising:

providing an assembly which comprises (i) a metal tube blank comprising a shape memory alloy, and (ii) a cold worked elongated metal core comprising a shape memory alloy, which is surrounded and contacted by the tube blank with minimal gap;

elongating the assembly by mechanical working;

subjecting the core to a treatment which results in the core being in a stretched condition throughout its length, and which does not substantially stretch the tube;

removing the stretched core from the and drawing the tube over a nondeformable mandrel or a floating plug, thereby refining the precision of diametric and wall dimensions with improved inner diameter and outer diameter surface quality.

30. A seamless tube made by the method defined in claim 29.

* * * * *